US008337248B1

(12) United States Patent
Lan et al.

(10) Patent No.: US 8,337,248 B1
(45) Date of Patent: Dec. 25, 2012

(54) CONNECTOR ASSEMBLY

(75) Inventors: Rong-Qin Lan, New Taipei (TW); Li-Jun Xu, New Taipei (TW); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/271,232

(22) Filed: Oct. 12, 2011

(51) Int. Cl.
*H01R 13/648* (2006.01)

(52) U.S. Cl. ..... 439/607.35; 439/79

(58) Field of Classification Search ..... 439/607.35, 439/79, 607.37
See application file for complete search history.

(56) References Cited

U.S. PATENT DOCUMENTS 7,144,258 B2 * 12/2006 Ariga et al. ..... 439/76.1
7,682,200 B2 * 3/2010 Zheng et al. ..... 439/660
8,007,290 B1 * 8/2011 Wolff et al. ..... 439/79
8,142,225 B2 * 3/2012 Yu ..... 439/607.35

* cited by examiner

*Primary Examiner* — Hien Vu
(74) *Attorney, Agent, or Firm* — Lin & Associates IP, Inc.

(57) ABSTRACT

A connector assembly includes a printed circuit board defining an inserting window and soldering holes adjacent to two sides of the inserting window, and an electrical connector assembled in the inserting window. The electrical connector includes an insulating body, terminals disposed in the insulating body and each having a soldering arm levelly extending rearward to stretch behind the insulating body, and a shell enclosing the insulating body and the terminals. Each side board of the shell has a substantial middle punched outward to form a soldering board extending levelly, and a lower part of a rear edge punched outward and then bent downward to form a soldering tail inserted downward in the soldering hole of the printed circuit board. The soldering boards of the shell and the soldering arms of the terminals are flush with one another to be levelly against and further soldered onto the printed circuit board.

2 Claims, 3 Drawing Sheets

CONNECTOR ASSEMBLY

BACKGROUND OF THE INVENTION

1. Field of the Invention

The present invention relates to a connector assembly, and more particularly to a connector assembly having an electrical connector and a printed circuit board electrically connected with the electrical connector.

2. The Related Art

With the development of electronic technology, electronic products are required to be miniaturized more and more. Therefore, a connector assembly assembled in the electronic product is required to occupy a space as small as possible in the electronic product. The connector assembly includes a printed circuit board and an electrical connector. However, the electrical connector and the printed circuit board are assembled together traditionally by locating the electrical connector on a surface of the printed circuit board. This causes the connector assembly to occupy a larger space in the electronic product so that the electronic product is unfavourable to be miniaturized. Therefore, a connector assembly capable of miniaturizing the electronic product in size largely is required.

SUMMARY OF THE INVENTION

It is an object of the present invention to provide a connector assembly. The connector assembly includes a printed circuit board defining an inserting window penetrating forward through a front edge thereof and a plurality of soldering holes adjacent to two sides of the inserting window, and an electrical connector assembled in the inserting window of the printed circuit board. The electrical connector includes an insulating body having a base portion and a tongue portion extending forwardly from a front of the base portion, a plurality of terminals disposed in the tongue portion of the insulating body and each having a soldering arm levelly extending rearward to stretch out of a rear surface of the base portion, and a shell having a top board, two facing side boards and two butt-joined bottom boards of which rear edges are provided with a plurality of mounting portions. The rear surface of the base portion defines a plurality of mounting fillisters. The insulating body together with the terminals is inserted in the shell, with the base portion being secured in a rear of the shell by means of the mounting portions buckled in the mounting fillisters respectively, and the tongue portion being spaced from periphery insides of the shell to define an inserting space therebetween for receiving an external mating connector. Each side board has a substantial middle thereof punched outward to form a soldering board extending levelly, and a lower part of the rear edge thereof punched outward and then bent downward to form a soldering tail inserted downward in the corresponding soldering hole of the printed circuit board. The soldering boards of the shell and the soldering arms of the terminals are flush with one another to be levelly against and further soldered onto a top face of the printed circuit board.

As described above, as the electrical connector is disposed in the inserting window of the printed circuit board, not only the height of the connector assembly but also the space occupied by the connector assembly in an electronic product are reduced. Therefore, the electronic product can be miniaturized in size more and more. Moreover, the electrical connector is electrically connected with the printed circuit board by means of the soldering tails of the shell being inserted in the soldering holes, the soldering boards of the shell and the soldering arms of the terminals being levelly soldered onto the printed circuit board, so that achieves a steady connection between the electrical connector and the printed circuit board. The mounting portions of the shell are buckled in the mounting fillisters of the insulating body to further realize a firm assembly of the shell and the insulating body.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
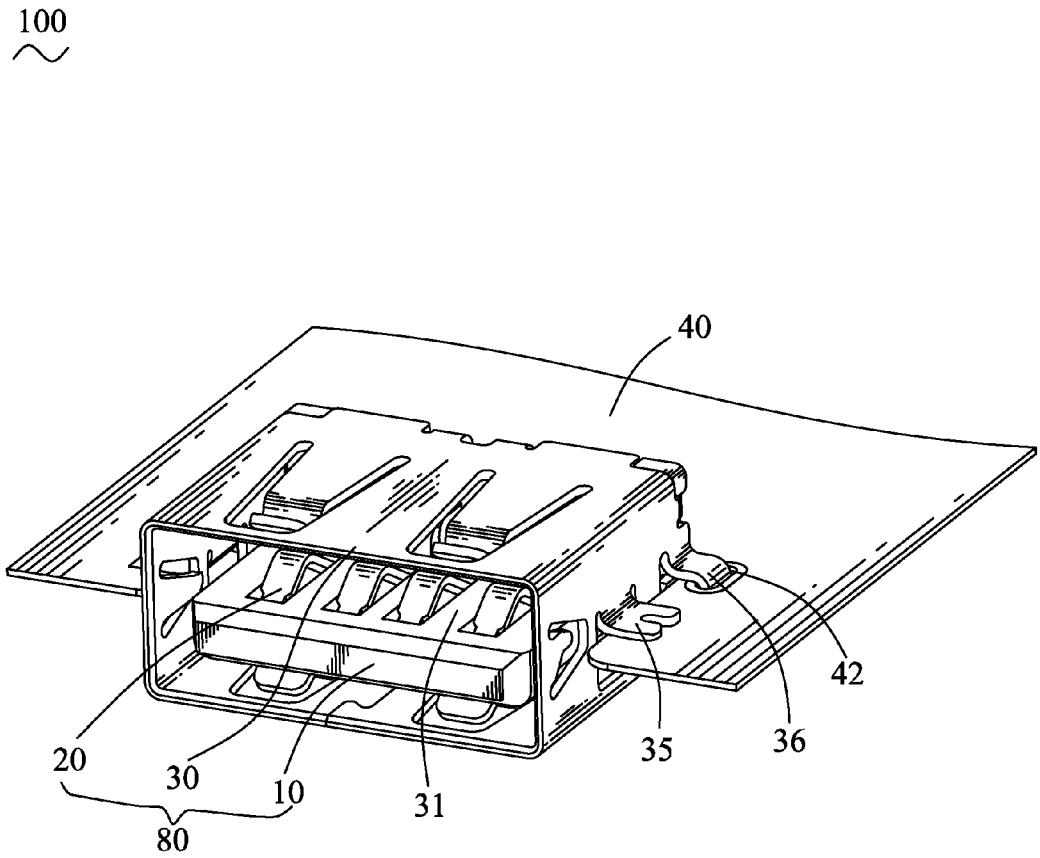
FIG. 1 is an assembled perspective view of a connector assembly in accordance with an embodiment of the present invention.

Referring to FIG. 1, a connector assembly 100 according to an embodiment of the present invention is shown. The connector assembly 100 includes a printed circuit board 40 and an electrical connector 80. A middle of a front of the printed circuit board 40 defines a rectangular inserting window 41. A plurality of soldering holes 42 is formed at two sides of the inserting window 41 of the printed circuit board 40.

Figure 2:
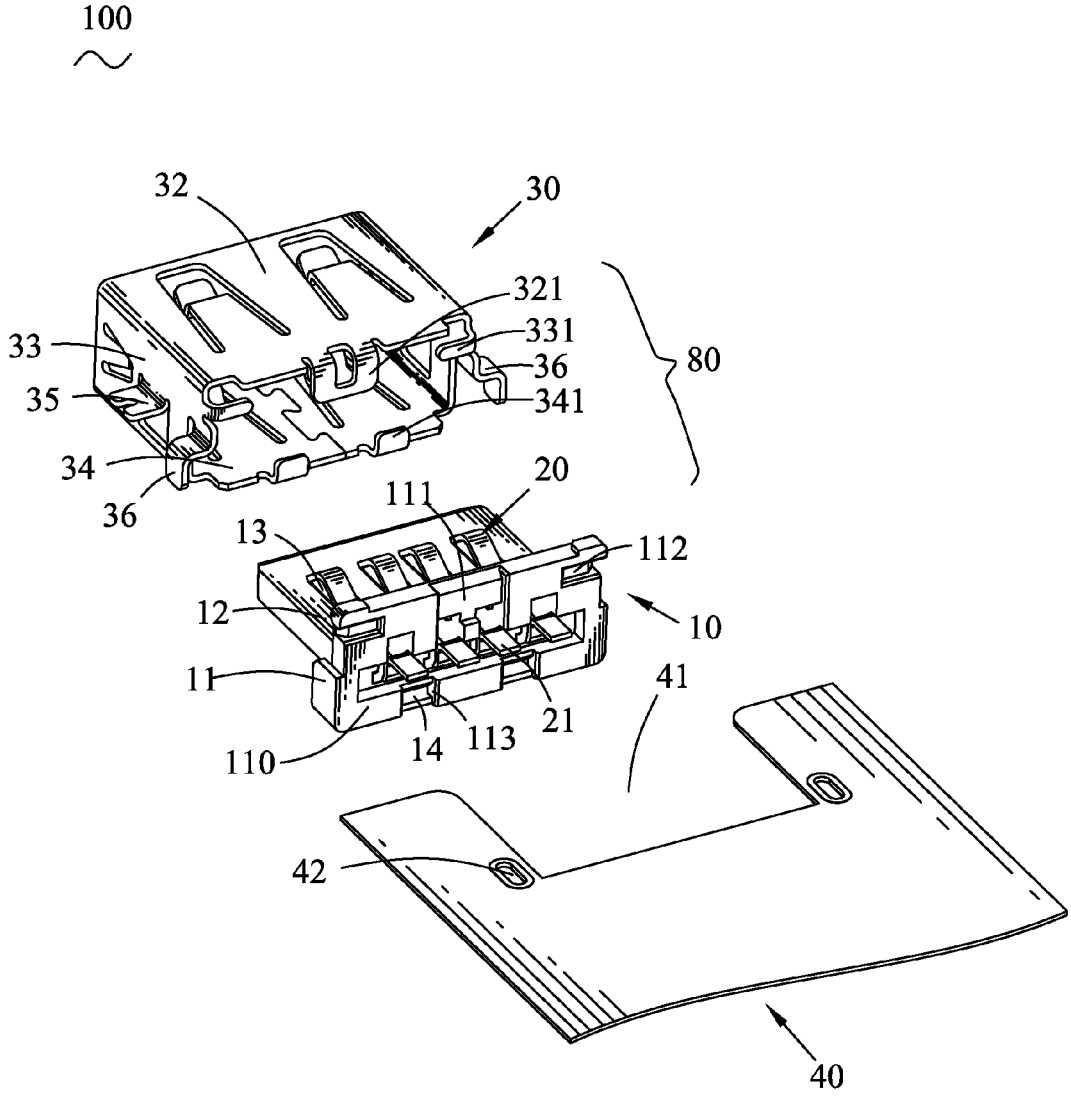
FIG. 2 is an exploded perspective view of the connector assembly of FIG. 1.

Referring to FIG. 2, the electrical connector 80 includes a shell 30, an insulating body 10 enclosed in the shell 30 and a plurality of terminals 20 disposed in the insulating body 10. The shell 30 is curved from a metal plate to show a rectangular shape, and has a top board 32, two facing side boards 33 and two butt-joined bottom boards 34. Rear edges of the shell 30 are provided with a plurality of mounting portions. In this embodiment, the mounting portions include a first mounting portion 321 bent downward from a middle of a rear edge of the top board 32, two second mounting portions 331 bent towards each other from upper parts of rear edges of the side boards 33, and two third mounting portions 341 bent upward from substantial middles of rear edges of the bottom boards 34. Each side board 33 of the shell 30 has a substantial middle thereof punched outward to form a soldering board 35 extending levelly, and a lower part of the rear edge thereof punched outward and then bent downward to form a soldering tail 36.

The insulating body 10 has a rectangular base portion 11 mating with a rear of the shell 30 and a board-shaped tongue portion 12 extending forwardly from a middle portion of a front of the base portion 11. A top side of the tongue portion 12 defines a plurality of terminal cavities 13 arranged at regular intervals along a transverse direction thereof and each further extending rearward to pass through the base portion 11. A rear surface 110 of the base portion 11 defines a plurality of mounting fillisters. In the embodiment, the mounting fillisters include a first mounting fillister 111 opened in a middle of a top of the rear surface 110 of the base portion 11 and further penetrating upward through a top edge of the base portion 11, two second mounting fillisters 112 concaved towards each other from upper parts of rear side edges of the base portion 11, and two third mounting fillisters 113 apart opened in a bottom of the rear surface 110 and further penetrating downward through a bottom edge of the base portion 11. A middle of each third mounting fillister 113 further penetrates forward through the front of the base portion 11 to form a fastening fillister 14.

Figure 3:
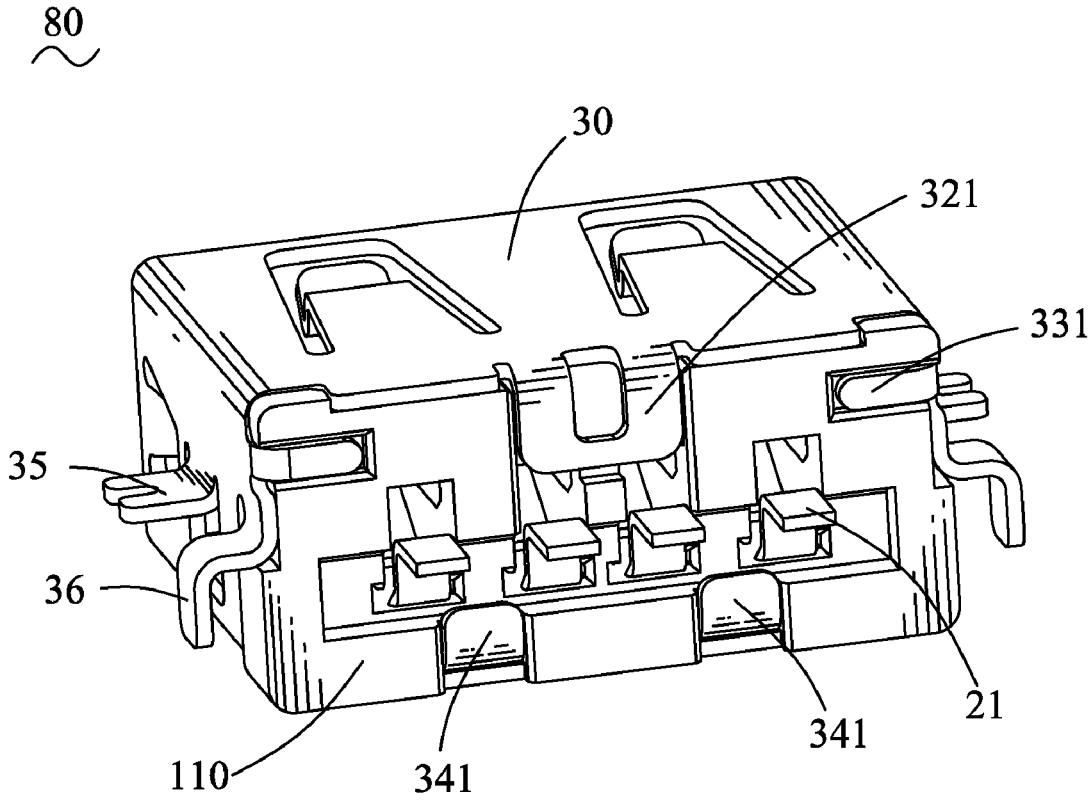
FIG. 3 is an assembled perspective view of an electrical connector of the connector assembly of FIG. 1.

Referring to FIG. 1, FIG. 2 and FIG. 3, in assembly, the terminals 20 are disposed in the terminal cavities 13 of the insulating body 10 respectively. Each of the terminals 20 has a soldering arm 21 levelly extending rearward to stretch out of the rear surface 110 of the base portion 11. The insulating body 10 together with the terminals 20 is enclosed in the shell 30, with the base portion 11 being secured in the rear of the shell 30 by means of the first and second mounting portions 321, 331 buckled in the first and second mounting fillisters 111, 112, and the third mounting portions 341 passing through the fastening fillisters 14 to be buckled in the third mounting fillisters 113. The tongue portion 12 is spaced from periphery insides of the shell 30 to define an inserting space 31 between the tongue portion 12 and the periphery insides of the shell 30 for receiving an external mating connector (not shown). Last, the electrical connector 80 is assembled in the inserting window 41 of the printed circuit board 40, with the soldering tails 36 of the shell 30 being inserted downward in the soldering holes 42, the soldering boards 35 of the shell 30 and the soldering arms 21 of the terminals 20 being flush with one another to be levelly against and further soldered onto a top face of the printed circuit board 40.

As described above, as the electrical connector 80 is disposed in the inserting window 41 of the printed circuit board 40, not only the height of the connector assembly 100 but also the space occupied by the connector assembly 100 in an electronic product (not shown) are reduced. Therefore, the electronic product can be miniaturized in size more and more. Moreover, the electrical connector 80 is electrically connected with the printed circuit board 40 by means of the soldering tails 36 of the shell 30 being inserted in the soldering holes 42, the soldering boards 35 of the shell 30 and the soldering arms 21 of the terminals 20 being levelly soldered onto the printed circuit board 40, so that achieves a steady connection between the electrical connector 80 and the printed circuit board 40. The mounting portions of the shell 30 are buckled in the mounting fillisters of the insulating body 10 to further realize a firm assembly of the shell 30 and the insulating body 10.

What is claimed is:

1. A connector assembly, comprising:

a printed circuit board defining an inserting window penetrating forward through a front edge thereof, and a plurality of soldering holes adjacent to two sides of the inserting window; and an electrical connector assembled in the inserting window of the printed circuit board, and including an insulating body having a base portion and a tongue portion extending forwardly from a front of the base portion, a rear surface of the base portion defining a plurality of mounting fillisters, a plurality of terminals disposed in the tongue portion of the insulating body, each terminal having a soldering arm levelly extending rearward to stretch out of the rear surface of the base portion, and a shell having a top board, two facing side boards and two butt-joined bottom boards of which rear edges are provided with a plurality of mounting portions, the insulating body together with the terminals being inserted in the shell, with the base portion being secured in a rear of the shell by means of the mounting portions buckled in the mounting fillisters respectively, and the tongue portion being spaced from periphery insides of the shell to define an inserting space therebetween for receiving an external mating connector, each side board having a substantial middle thereof punched outward to form a soldering board extending levelly, and a lower part of the rear edge thereof punched outward and then bent downward to form a soldering tail, wherein the soldering tails of the shell are inserted downward in the soldering holes of the printed circuit board, the soldering boards of the shell and the soldering arms of the terminals are flush with one another to be levelly against and further soldered onto a top face of the printed circuit board.

2. The connector assembly as claimed in claim 1, wherein the mounting fillisters include a first mounting fillister opened in a middle of a top of the rear surface of the base portion and further penetrating upward through a top edge of the base portion, two second mounting fillisters concaved towards each other from upper parts of rear side edges of the base portion, and two third mounting fillisters apart opened in a bottom of the rear surface and further penetrating downward through a bottom edge of the base portion, a middle of each third mounting fillister further penetrates forward through the front of the base portion to form a fastening fillister, the mounting portions include a first mounting portion bent downward from a middle of the rear edge of the top board to be buckled in the first mounting fillister, two second mounting portions bent towards each other from upper parts of the rear edges of the side boards to be buckled in the second mounting fillisters, and two third mounting portions passing rearward through the fastening fillisters and then bent upward from substantial middles of the rear edges of the bottom boards to be buckled in the third mounting fillisters.

* * * * *